US005207236A

United States Patent [19]

Santhouse

[11] Patent Number: 5,207,236

[45] Date of Patent: May 4, 1993

[54] WATER RESERVOIR TO PROVIDE MIST FOR A HAIRSETTER

[75] Inventor: Daniel Santhouse, Wilton, Conn.

[73] Assignee: Conair Corporation, Stamford, Conn.

[21] Appl. No.: 742,005

[22] Filed: Aug. 8, 1991

[51] Int. Cl.[5] ..... A45D 1/02

[52] U.S. Cl. ..... 132/227; 132/228

[58] Field of Search ..... 132/271, 272, 227, 228, 132/229, 233; 261/DIG. 65

[56] References Cited

U.S. PATENT DOCUMENTS

| | | | |
|---|---|---|---|
| 1,534,624 | 4/1925 | Weidlich | 261/DIG. 65 |
| 3,519,793 | 7/1970 | Solomon | 132/229 X |
| 3,654,428 | 4/1972 | Talge et al. | 132/229 X |
| 3,666,915 | 5/1972 | De Napoli | 132/228 X |
| 4,516,011 | 5/1985 | Jeffress et al. | 132/229 X |
| 4,565,204 | 1/1986 | Skovdal | 132/228 |

*Primary Examiner*—John J. Wilson
*Assistant Examiner*—Jeffrey A. Smith
*Attorney, Agent, or Firm*—Haynes N. Johnson

[57] ABSTRACT

A reservoir unit for use in a hairsetter which has upwardly-extending heating posts. The reservoir unit has a cup to hold water, the cup having a base and sides and being open at the top, and the base having an upwardly-extending heating post recess therein. The recess has a shape complementary to that of the heating posts, so that the reservoir unit may be filled with water and placed upon one of the heating posts to heat the water and so moisten hair rollers mounted on others of the posts. The reservoir may have an upwardly-extending handle for use in placing it upon and removing it from the heating post.

5 Claims, 3 Drawing Sheets

WATER RESERVOIR TO PROVIDE MIST FOR A HAIRSETTER

FIELD OF THE INVENTION

This invention relates to the field of hairsetters which hold a plurality of hair rollers and heat them prior to use. In particular, it relates to a reservoir-type device, fitting inside the hairsetter, which is a source of steam to mist, or moisten, the rollers.

BACKGROUND OF THE INVENTION

Hairsetters are enclosed devices for heating hair rollers prior to use. Usually, in order to be heated, the rollers are fitted over heated posts.

Some hairsetters have heated receptacles for water, so that steam can be created within the hairsetter to moisten the hair rollers as they are being heated. In others the inside base is heated, and the user places water directly on the base. Some provide a separate chamber to moisten the rollers after they have been heated.

Examples of moistening systems are found in Talge et al. U.S. Pat. No. 3,654,428, De Napoli U.S. Pat. No. 3,666,915, Kelmann et al. U.S. Pat. No. 3,749,106, and Walter U.S. Pat. No. 3,858,029.

The present invention is directed to hairsetters which do not have steaming devices built in, and provides an inexpensive way to create steam for the rollers.

BRIEF SUMMARY OF THE INVENTION

The present invention is adapted to be used in hairsetters of the type that have heated posts to heat hair rollers, the rollers having depressions in their bases so that they can fit about the posts. Such hairsetters normally have a dozen or more posts and a similar number of hair rollers, often of differing sizes. The top of the hairsetter can open and close so that the rollers can be held in an enclosed space while they are being heated.

I replace one of the rollers with a reservoir unit. This unit is a cup with an open top, and its sides and bottom form a container for water. The underside of its bottom has a concave depression so that it can fit on one of the heating posts. The unit is filled with water and placed on one of the posts. The water then vaporizes, creating a steam or mist which settles on the rollers, moistening them. Preferably, the reservoir unit has an upwardly extending handle so that it can readily be removed for refilling.

DETAILED DESCRIPTION OF THE INVENTION

Figure 1:
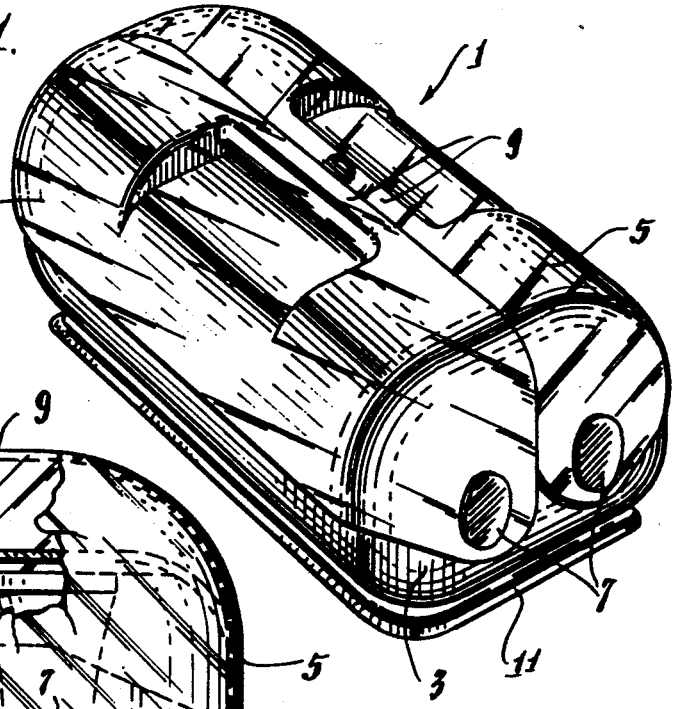
FIG. 1 is a perspective view of a closed hairsetter. It has a two-piece pivoted top which can open and close.
Figure 2:
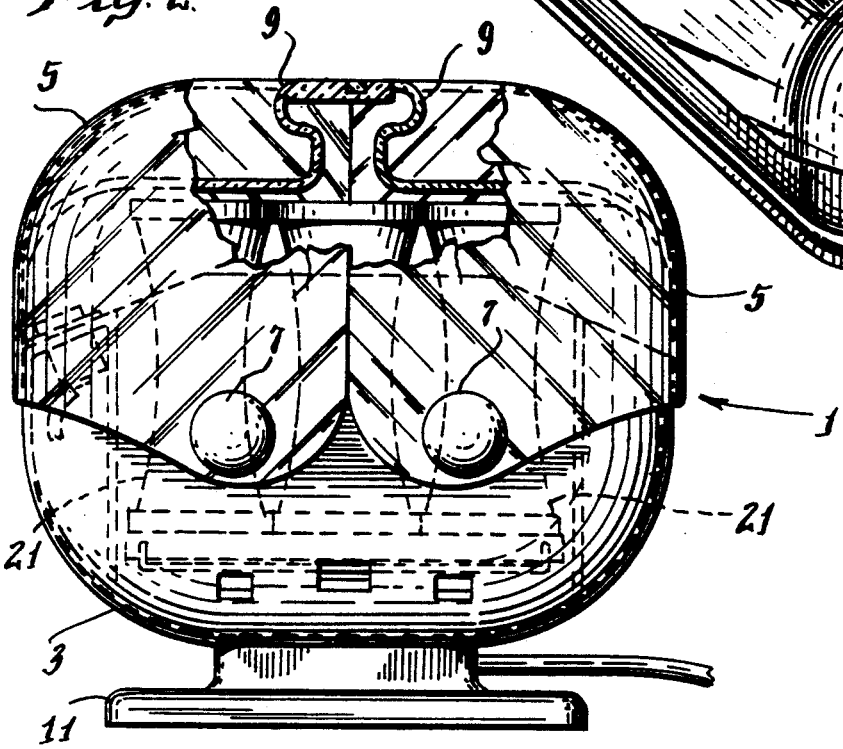
FIG. 2 is an end view of the hairsetter (closed), partially broken away to show hair rollers therein.

My water reservoir unit, to supply steam, is used in hairsetters having heating posts. A typical one would be hairsetter 1 with base 3 and a two-piece top 5 which opens and closes about pivots 7. It has a handle 9 and is mounted on stand 11.

Inside the hairsetter 1 is a heated base plate 13 with a plurality (usually from about a dozen to twenty) of heating posts 15, heated by a heating element in the same manner as the base plate 13. The posts have an angled lower base portion 17.

Rollers 21 fit within the hairsetter over the heating posts 15 to be heated. They normally have an angled indentation 23 in their base with a concave post recess 25 in the center of the indentation. The shape of the roller base complements the shape of the heating post and its angled base portion, in order to provide good heat contact.

Figure 3:
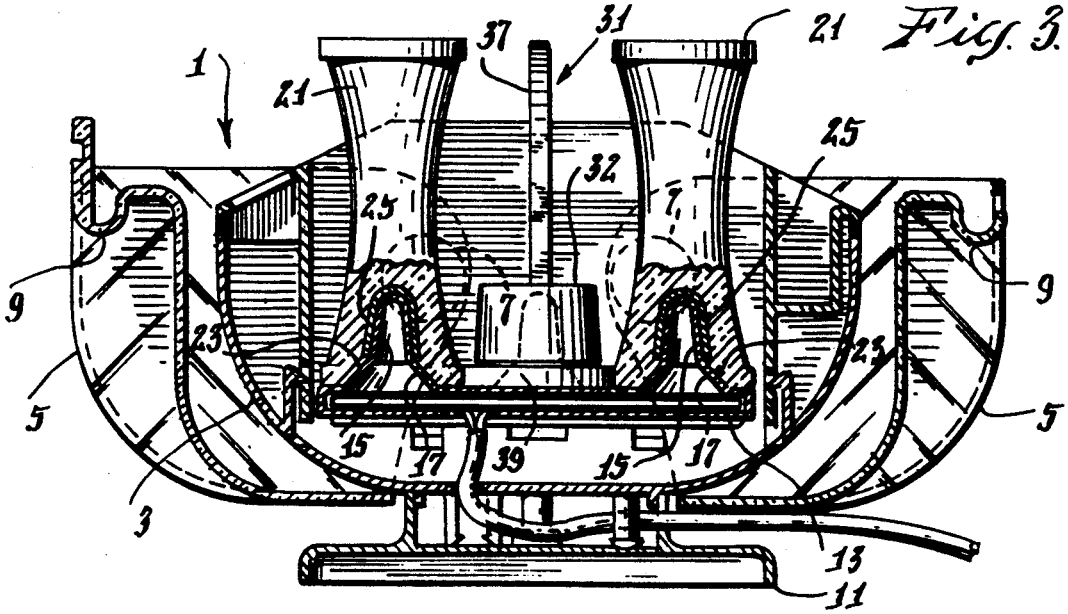
FIG. 3 is like FIG. 2 except the hairsetter is open, and it is a section taken on line 3—3 of FIG. 4.
Figure 4:
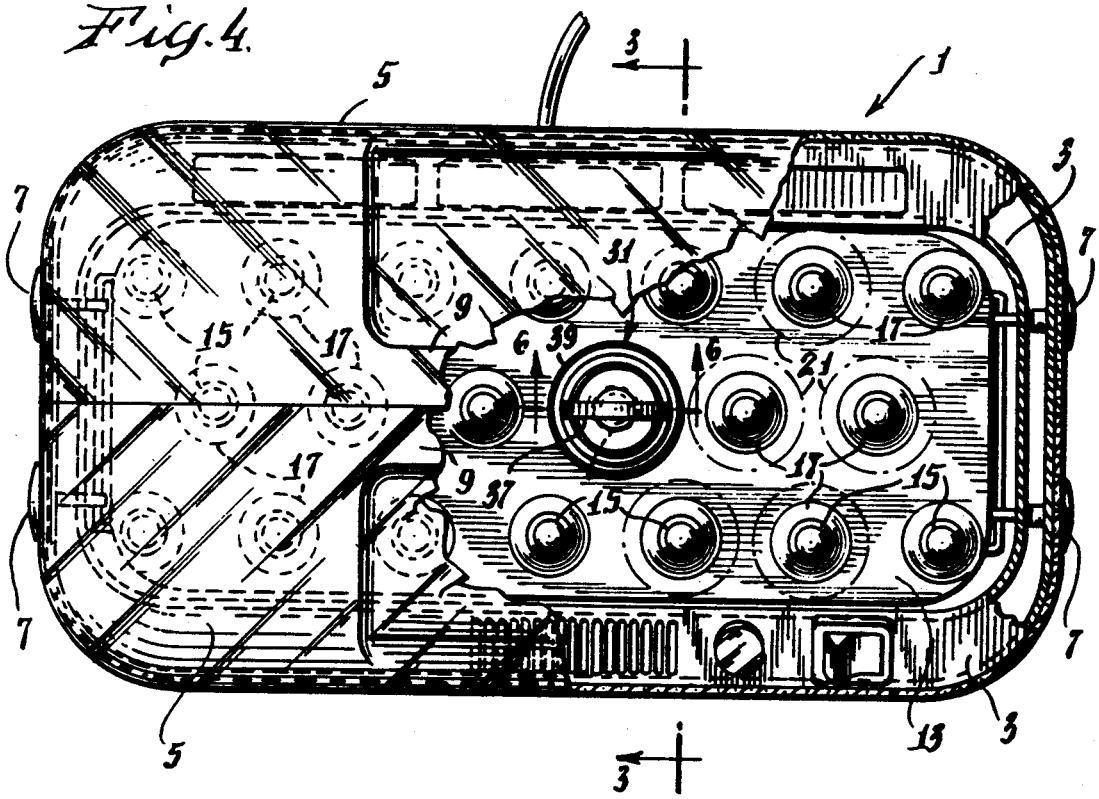
FIG. 4 is a top plan view, partially broken away.
Figure 5:
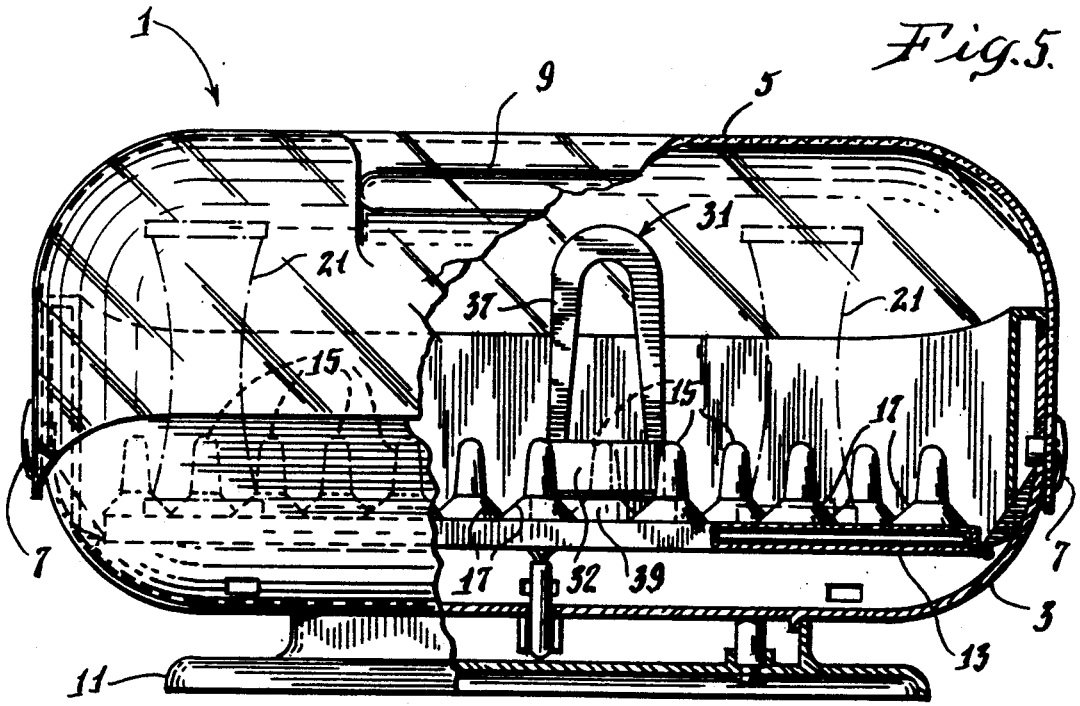
FIG. 5 is a side elevation, partially broken away.
Figure 6:
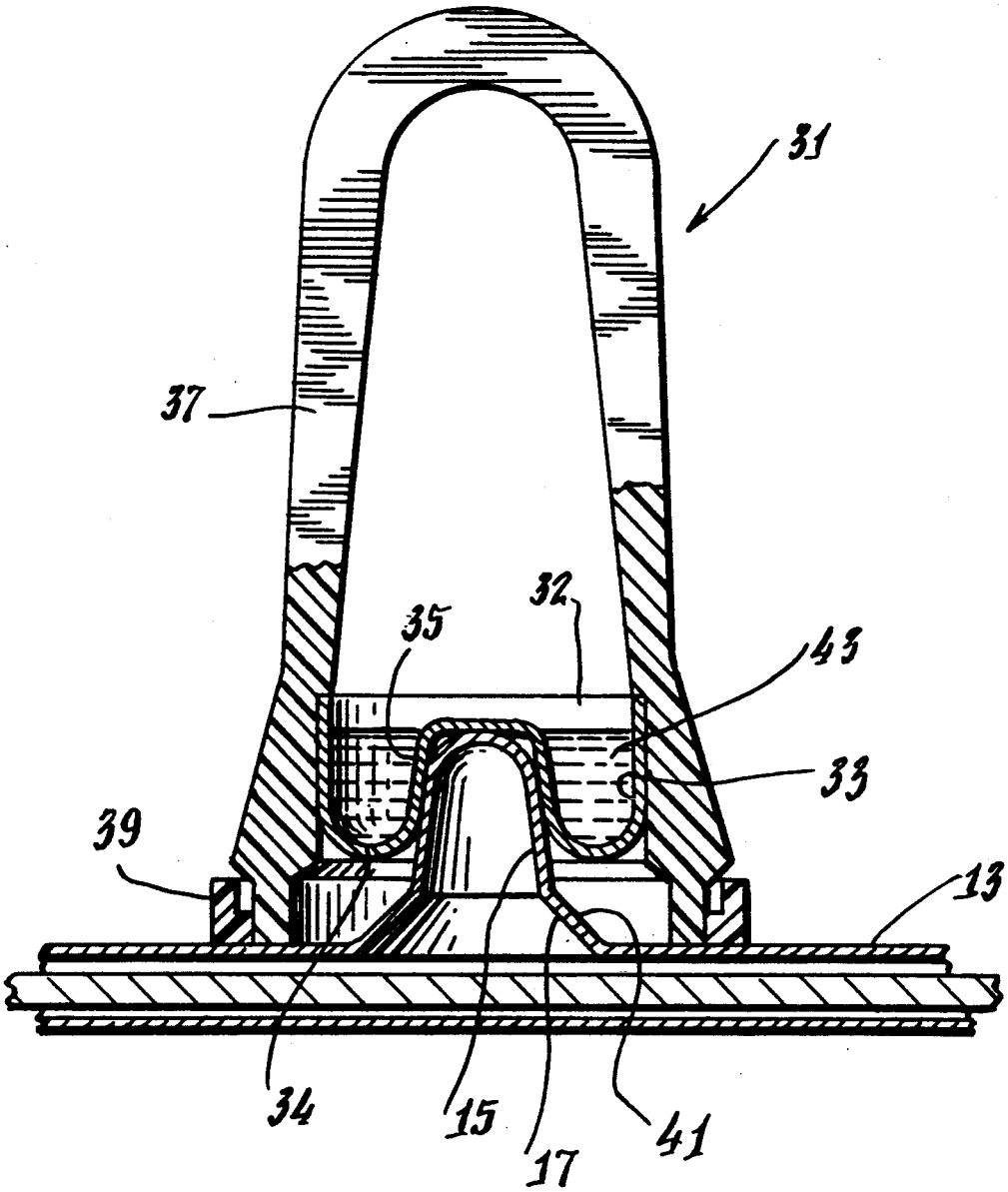
FIG. 6 is a section of the reservoir unit, taken on line 6—6 of FIG. 4.

My water reservoir unit 31 is best seen in FIGS. 3 to 6. It includes a cup 32 with sides 33 and base 34. The base has a concave heating post recess 35 in it. The post recess 35 is part of and extends into the cup 32. Concave recess 35 has a shape which complements that of the heating post 15, providing good heat contact.

Reservoir unit 31 has an upwardly-extending, inverted U-shaped handle 37, the base portion 39 of which fits about cup 32. This allows one to remove the unit for refilling without having to reach down among the heated posts and without having to touch the hot cup 32. Base portion 39 has an angled recess 41 in it to fit about the angled base 17 of the heating post.

The reservoir can be molded of plastic or formed of metal, such as aluminum. As with some hair rollers, one configuration would have the entire unit molded, except for the cup 32 with its heating post recess 35, which would be metal for better heat conductivity.

To use the reservoir, one removes one of the hair rollers, so as to provide a free heating post for the reservoir unit. Preferably, the heating post chosen will be near the center of the hairsetter. Water 43 is then placed in the cup 32 and the unit positioned on the empty heating post. Heat from the post will heat the water and cause steam or vapor to be emitted, which will condense on the remaining hair rollers, moistening them.

I claim:

1. In a hairsetter having heating posts and heating means therefor, said posts being vertically mounted on a heated base, and hair rollers for mounting on said posts, that improvement including at least one reservoir unit, said reservoir unit having a cup shaped to hold liquid, said cup having a base and sides and being open at the top, said base having an upwardly-extending concave heating post recess therein, said recess being integral with said base, said recess extending within said cup, and said recess having a shape complementary to that of said heating posts, whereby said reservoir unit may be filled with water and placed upon one of said heating post to heat the water therein so that said hair rollers may be moistened.

2. A reservoir unit as set forth in claim 1 including a U-shaped handle extending upwardly from said cup.

3. A hairsetter adapted to moisten hair rollers as they are being heated, said hairsetter including a closable housing, a plurality of vertical heating posts within said housing, means for heating said posts, a plurality of hair rollers fitting on said posts, a reservoir unit, said reservoir unit including an open cup shaped to hold liquid and having sides and a base, said base having an upwardly-extending heating post recess extending into said cup and being integral therewith and dimensioned for complementary fit about one of said heating posts, whereby said cup may be filled with water to be heated and vaporized.

4. A hairsetter as set forth in claim 3 including a handle fitting about said cup and extending upwardly therefrom.

5. A reservoir unit for use in a hairsetter having upwardly-extending heating posts, said reservoir unit including a cup shaped to hold liquid, said cup having a base and sides and being open at the top, said base having an upwardly-extending concave heating post recess therein, said recess being integral with said base, said recess having a shape complementary to that of said heating posts, and a handle extending upwardly from said cup, whereby said reservoir unit may be filled with water and placed upon one of said heating posts to heat the water therein.

* * * * *